United States Patent [19]

Shirley-Smith et al.

[11] Patent Number: 4,817,251

[45] Date of Patent: Apr. 4, 1989

[54] FASTENER FOR ATTACHING BUTTONS AND THE LIKE TO FABRIC

[75] Inventors: Leo D. Shirley-Smith, Malbury; Michael Winning, London, both of England

[73] Assignee: Modern Milly Limited, England

[21] Appl. No.: 107,895

[22] Filed: Oct. 13, 1987

Related U.S. Application Data

[63] Continuation of Ser. No. 702,503, Feb. 19, 1985, abandoned.

[30] Foreign Application Priority Data

Feb. 18, 1984 [GB] United Kingdom ..... 8404338
Jul. 13, 1984 [GB] United Kingdom ..... 8417842

[51] Int. Cl.[4] ..... A44B 9/00

[52] U.S. Cl. ..... 24/710.4; 24/112; 24/103; 24/525; 24/538; 24/707.7; 24/711.3; 24/706.2

[58] Field of Search ..... 24/150 R, 112, 103, 24/105, 152, 490, 513, 516, 525, 538, 539

[56] References Cited

U.S. PATENT DOCUMENTS

| | | | |
|---|---|---|---|
| 401,084 | 4/1889 | Thomas | 24/112 |
| 982,264 | 1/1911 | Forester | 24/112 |
| 1,043,027 | 10/1912 | Newman | 24/150 R X |
| 1,066,288 | 7/1913 | Kokernot | 24/150 R |
| 1,310,804 | 7/1919 | Phelps | 24/152 X |
| 1,669,415 | 5/1928 | Holmes | 24/152 |
| 2,624,087 | 1/1953 | Love, Jr. | 24/150 R |
| 2,804,668 | 9/1957 | Rubenstein | 24/103 |
| 3,066,369 | 12/1962 | Anderson | 24/112 X |
| 3,237,261 | 3/1966 | Homonuff | 24/150 R |
| 4,005,507 | 2/1977 | Yamazaki | 24/150 R |
| 4,097,969 | 7/1978 | Nysten | 24/103 X |

FOREIGN PATENT DOCUMENTS

| | | | |
|---|---|---|---|
| 236309 | 7/1911 | Fed. Rep. of Germany . | |
| 853528 | 7/1949 | Fed. Rep. of Germany . | |
| 1011200 | 6/1957 | Fed. Rep. of Germany | 24/150 R |
| 2817251 | 11/1978 | Fed. Rep. of Germany . | |
| 3011848 | 1/1981 | Fed. Rep. of Germany . | |
| 319873 | 3/1902 | France | 24/150 R |
| 2065976 | 7/1971 | France . | |
| 2425818 | 5/1978 | France . | |
| 133875 | 9/1929 | Switzerland . | |
| 492884 | 9/1938 | United Kingdom | 24/112 |
| 2090627 | 7/1982 | United Kingdom . | |

*Primary Examiner*—Kenneth J. Dorner
*Assistant Examiner*—Laurie K. Cranmer
*Attorney, Agent, or Firm*—Woodard, Emhardt, Naughton Moriarty & McNett

[57] ABSTRACT

A fastening device for securing, for example, two pieces of fabric together comprises an outer body and an outer body secured in the outer body for rotational and axial movement relative thereto so that the inner body can move outwardly and inwardly of the outer body. The inner body carries a securing element in the form of a hook or spiral so that when the inner body is moved out of the outer body the securing element can be engaged in, say, the two pieces of fabric which, when the inner body is moved axially inwardly, are trapped between the securing element and the outer body.

15 Claims, 4 Drawing Sheets

FASTENER FOR ATTACHING BUTTONS AND THE LIKE TO FABRIC

This application is a continuation of application Ser. No. 702,503, filed Feb. 19, 1985, now abandoned.

This invention relates to fasteners and it is an object of the present invention to provide a fastener which is neat in appearance, of relatively small size and which is versatile in use in that it can be used domestically, personally and possibly even industrally.

According to the present invention there is provided a fastener comprising a body, and a securing element supported relative to the body and adapted to be axially movable outwardly of the body to engage articles and/or materials to be fastened together and then inwardly of the body to secure and hold the articles and/or materials together.

Preferably, the fastener comprises an outer body adapted to be gripped by the user, and an inner body rotatable and axially movable relative to the outer body, the inner body carrying the securing element.

Preferably the inner body has at least one projection movably but non-detachably engaged in a cam groove or track in the outer body to permit the aforesaid rotational and axial movement.

Preferably the outer body is of toothed configuration at its end where it is applied to the articles and/or materials to be fastened together.

Preferably the inner body is two part, namely a first part carrying the securing element and engaging in the cam grooving or track and a second part which is connected to the first part to move the latter but which is also movable axially of the first part.

The securing element is preferably of spiral configuration, preferably with a pointed or sharp end, which end lies within the cam grooving or track when the securing element is inwardly of the body whereby the risk of injury to the user or wearer by the pointed or sharp end is obviated.

It will be manifest that rotation and outward axial movement of the securing element will, in effect, screw it into an article and/or material engaging position whereas rotation and inward axial movement will screw the securing element back into the body securely to hold the engaged articles and/or materials together.

According to another aspect of the invention there is provided a fastener comprising an outer body, an inner carrier mounted within the outer body for rotatable and axial movement relative to the body, and a securing element eccentrically supported on the carrier for movement therewith.

Preferably the configurations of the outer body and inner carrier are such that in one extreme position the securing element lies substantially or wholly within the outer body while in another extreme position the securing element is substantially or wholly clear of the outer body.

Preferably there are two eccentrically-disposed securing elements.

A preferred form of securing element is a hook. Preferably the hook is pointed.

The fastener may be formed of metal or plastics or combinations thereof.

The outer body may have a wall or similar formation standing proud of the surface adapted to abut the articles to be fastened together and the hook may have a prong or prongs parallel with said surface and adapted to be moved by the carrier between a position above the level of the wall for engaging in or disengaging from the articles to be fastened and a position below the level of the wall to lock the engaged articles together.

The aforesaid fasteners have many uses. They may, inter alia, be used to fasten garments together, or covers on chairs or other furniture, or textile or plastic coverings to walls or other surface or napkins on babies or jewelry or other ornamentation on individuals.

Embodiments of the present invention will now be described, by way of example, with reference to the accompanying drawings, in which.

Figure 1A:
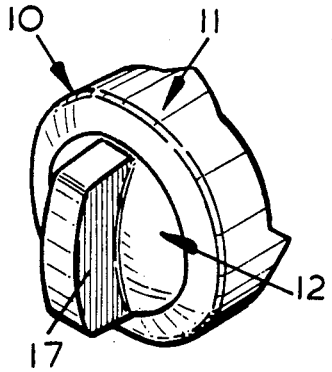
FIG. 1A is a perspective view of one form of the fastener.
Figure 1B:
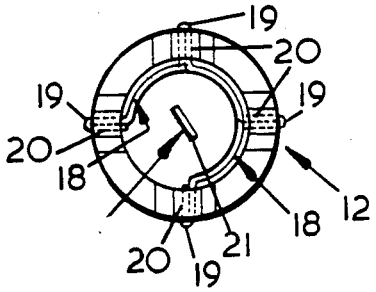
FIG. 1B is a rear, plan view of the fastener of FIG. 1A.
Figure 1C:
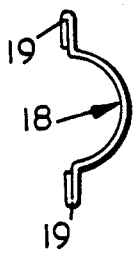
FIG. 1C is a plan view of the arcuate wires used in the fastener of FIG. 1A.
Figure 1D:
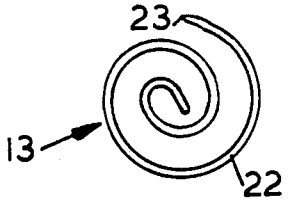
FIG. 1D is a plan view of the spiral wire securing element used in the fastener of FIG. 1A.
Figure 1E:
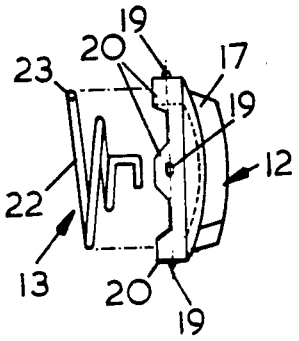
FIG. 1E is a side, exploded view showing the assembly relationship of the coil spring and the inner body of the fastener of FIG. 1A.
Figure 1F:
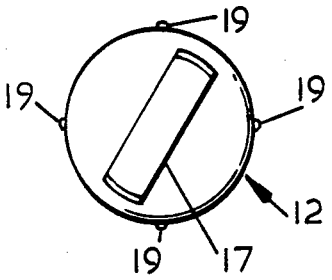
FIG. 1F is a front, plan view of the fastener of FIG. 1A.
Figure 1G:
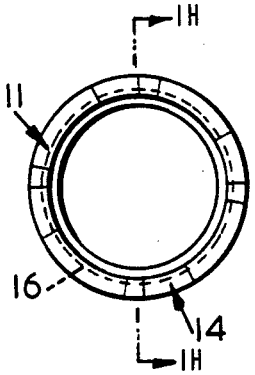
FIG. 1G is a rear, plan view of the outer body of the fastener of FIG. 1A.
Figure 1H:
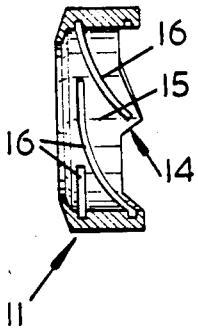
FIG. 1H is a side, cross-sectional view of the outer body of the fastener of FIG. 1A, taken along the line 1H—1H in FIG. 1G and looking in the direction of the arrows.

Referring to FIG. 1, the fastener is generally indicated at 10. It comprises an annular outer body designated 11, an inner circular body designated 12, and a securing element designated 13.

The inner and outer bodies 11 and 12 are preferably formed of plastics material while the securing element 13 is preferably of metal.

The outer annular body 11 at one end is of toothed configuration as indicated at 14 and it is this end which is pressed against the articles or materials to be fastened together. The toothed configuration 14 serves to resist rotation of the outer body 11 during the fastening and unfastening processes.

The inner cylindrical surface 15 of the outer annular body 11 has angularly-spaced cam grooves or tracks 16 extending circumferentially and axially of the cylindrical surface 15. Each cam groove or track 16 is closed at each end, i.e. a projection disposed in the track or groove can move back and forth but not out of an end of the track or groove.

The inner body 12 is of dished disc form with, on its outer surface, a finger grip 17. Within the dish of the disc is located at right angles to one another two arcuate wires 18 which have lateral projections 19 which extend through angularly-spaced teeth 20 of the disc 12 and project from the circumference of the latter.

These projections 19, when the inner body 12 is housed within the outer body 11, extend into the cam grooves or tracks 16 for movement therealong as aforesaid. The cooperation of the projections 19 and grooves 16 resist axial separation of the inner and outer bodies 12 and 11.

The inner body 12 at the centre of the dish has a groove 21 into which is fixed, for example, by adhesive the securing element 13 which is a spiral wire 22 with a pointed or relatively sharp end 23 to permit same to penetrate articles and/or materials to be fastened together.

Normally the spiral securing wire 22 lies substantially within the outer body 11 but rotation of the inner body 12 relatively to the outer body axially projects the spiral securing wire 22. The pointed wire 22, 23 is then, for example, passed through two layers of material to be joined. Reverse rotation screws the securing wire 22 back into the outer body 11 thus locking the two layers of material horizontally and axially together and the pointed end comes to rest in one of the grooves 16 to prevent said end from injuring the user or wearer.

Figure 2:
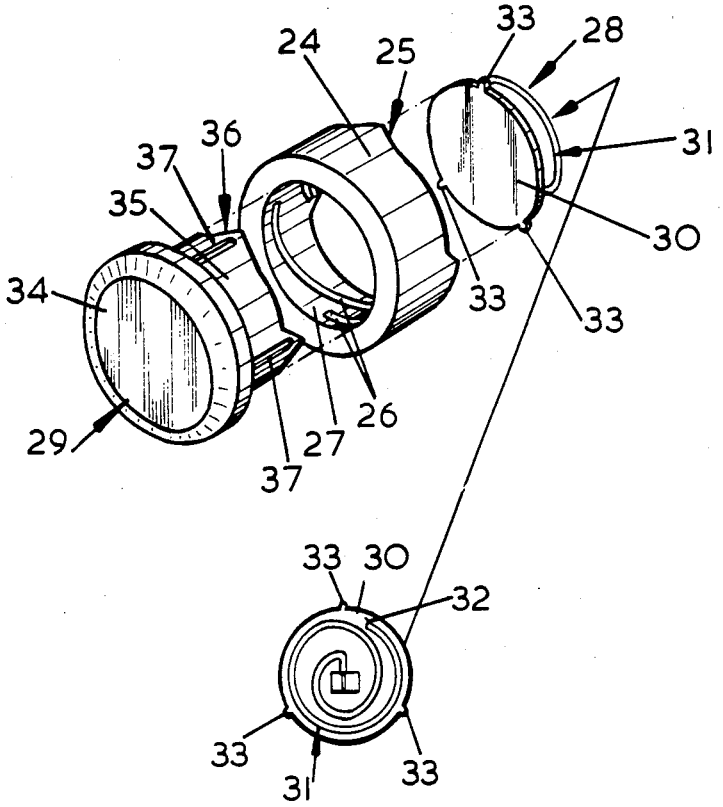
FIG. 2 is an exploded perspective view of a second form of fastener.

Reference is now made to FIG. 2 and in this embodiment the fastener again has an outer body 24 with a toothed configuration 25 at one end and closed-ended cam tracks or grooves 26 on its inner cylindrical surface 27.

The inner body is however two part 28, 29.

The part 28 is in the form of a disc 30 and has connected thereto a spiral wire securing element 31 with a pointed or relatively sharp end 32. The disc 30 has angularly-spaced circumferential projections 33 which movably engage in cam tracks or grooves 26 in the same manner as described with reference to FIG. 1.

The other inner part body 29 has a knurled gripping end disc 34 with an integral cylindrical body 35 terminating in a toothed configuration 36 and formed with axial slots 37 through which the projections 33 pass into the cam grooves or tracks 26.

This fastener operates in the same manner as that of FIG. 1 with the added feature that inner body part 29 is axially movable (due to slots 37) relative to the inner body part 28 and the outer body 24. This, with body part 29 extended, provides a finger grip for the user when fastening or releasing and when the fastener is in its securing mode the inner body part 29 is pressed into the outer body part 24 to lock the fastener in position.

Figures 3, 4A, 4B:
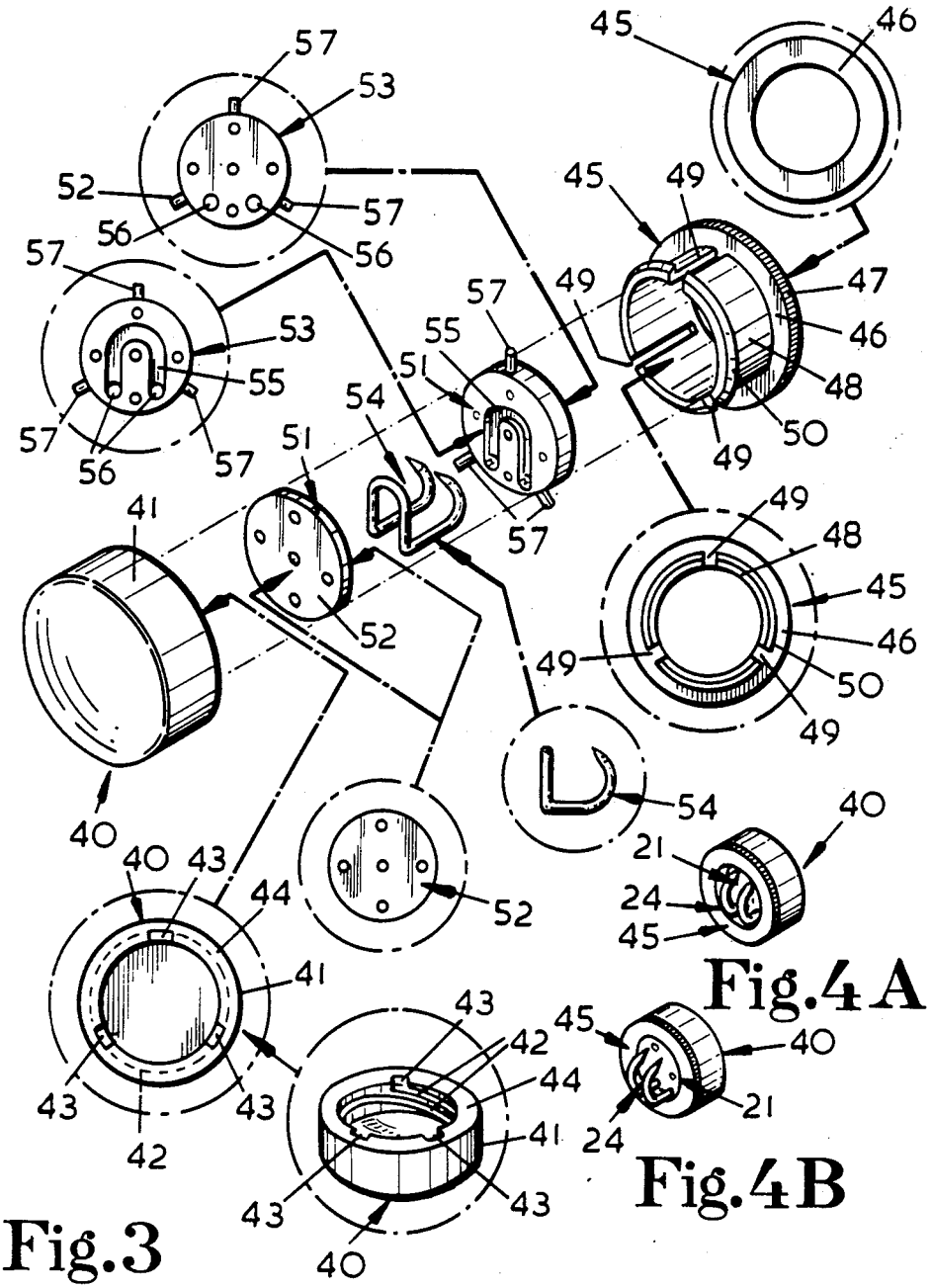
FIG. 3 is an exploded perspective view of a third form of fastener.
FIGS. 4A and 4B are perspective views, to a smaller scale, of the fastener of FIG. 3 in its normal position and in the position for engaging with or disengaging from, for example, materials to be fastened together.

The fastener of FIGS. 3, 4A and 4B is formed of metal.

It comprises an outer cup-shaped body 40, the wall 41 of which is spirally or helically grooved as indicated at 42 in its inner surface, the spirals or grooves 42 (three in this instance) terminating at cut-outs 43 in the end face 44 of the wall 41.

Rotatably secured in the cup-shaped body 40 is an annular operating ring 45 which comprises a circular flange 46 serrated at its circumference as indicated at 47 and which, when the operating ring 45 is fitted into the cup-shaped body 40, abuts and covers the end face 44 thus closing the cut-outs 43.

The operating ring 45 has a tubular body 48 lying inboard of the flange circumference, which tubular body 48 is formed with three equi-angularly spaced slots 49 extending its full length.

The operating ring 45 has a retention lip 50 at its flange remote end which engages the grooving 42, at the closed end of the cup-shaped body 40 to prevent axial displacement.

The fastener also comprises a carrier 51 comprising, in this instance, two plates 52, 53 which are rivetted together to secure on the carrier 51 a hook device 54 comprising two side-by-side hooks with pointed ends, the plate 53 being recessed at 55 to locate the hook device 54 and being formed with two holes 56 to allow projection of the hooks out of the carrier 51.

The plate 53 also has three equi-angularly spaced pins 57 extending radially from its circumference.

When assembled the operating ring 55 is inside the cup-shaped body 40 with the carrier 51 inside both, the pins 57 extending through the slots 49 and engaging in the respective grooves 42.

Normally the carrier 51 is in a position where the hooks of the hook device 54, which are eccentric of the fastener central axis, are disposed inside the cup-shaped body 40 (FIG. 4A).

To fasten, say, two pieces of fabric together the operating ring 45 is rotated relative to the body 40 to extend the hook device 54 out of the body 40 (FIG. 2B). The hook device 54 is engaged in both pieces of fabric and reverse rotation of the operating ring 45 relative to the body 40 moves the hook device 54 inwardly of the body 40 together with the two pieces of fabric which are thus fastened together. Release of the pieces of fabric is achieved by extending the hook device 54 out of the body 40 and unhooking the fastener from the pieces of fabric.

The fastener may be made of plastics material save for the hook device 54 and, in this instance, the fastener comprises only two components, namely a unitary carrier and hook device and a helically grooved body, the grooves being closed at the end face to prevent axial egress of the carrier from the body.

Figure 7:
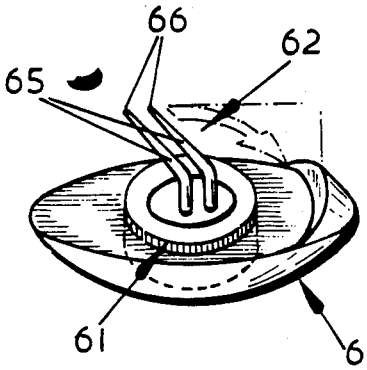
FIG. 7 is a perspective view of the fastener in the position for engaging in or release from, for example, the two pieces of fabric.
Figure 5:
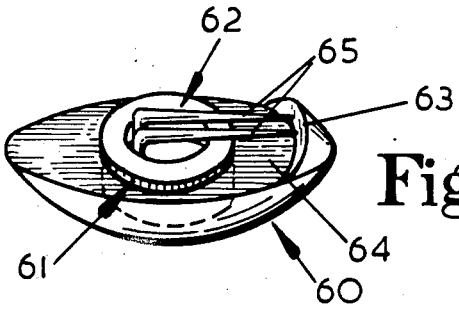
FIG. 5 is a perspective view of a fourth form of fastener in closed position.
Figure 6:
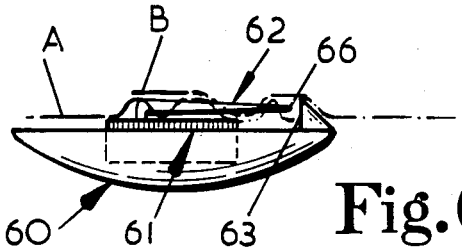
FIG. 6 is a side view of the fastener of FIG. 5 showing two pieces of fabric secured together by the fastener.

Referring to FIGS. 5 to 7, the fastener is preferably constituted in two parts and is formed of a plastics material save for the hook device.

The fastener comprises an outer body 60 and an internal carrier 61 with which the hook device 62 is integrated or connected, e.g. secured by being moulded in situ.

The outer body 60 is ovoid in plan view and has at one end an upstanding wall 63 which stands proud of the flat surface 64 of the fastener by an amount greater than the level occupied by the hook device 62 when in its normal or fastening mode.

The outer body 60 is helically grooved as described with reference to FIGS. 3, 4A and 4B.

The carrier 61 is a one-piece component (i.e. components 52, 53 and 45 of FIG. 3 integrated) and has the hook device 62 secured thereto by moulding. It is to be noted that in this embodiment the prongs 65 of the hook device 62 are straight and lie parallel with the flat surface 64 of the outer body 60.

When it is desired to fasten two pieces A,B of fabric together for example, the carrier 61 and hook device 62 are rotated through 90° to the position shown in FIG. 7. This causes the carrier 61 and the hook device 62 to move axially outwardly of the outer body 60. The hook device 62 can then be engaged through the two pieces of fabric A and B to be fastened together and, by rotating the carrer 61 and the hook device 62 back through the 90° arc, the carrier 61 and the hook device 62 are caused to move axially inwardly of the outer body 60 thus securing the pieces of fabric A and B together. It will be seen from FIG. 6 that the points 66 of the hook device 62 lie immediately adjacent the wall 63 thus preventing disengagement of the fastener from the pieces of fabric A and B.

When it is preferred that the securing element of the aforesaid fastener is carried by the inner body it is visualised that it may be carried by the outer body which is axially movable relative to the inner body and that in article-securing mode it may cooperate with the inner body to lock the fastened articles together.

References therefore to "inner" and "outer" in the accompanying claims should be construed accordingly where the context permits.

We claim:

1. A fastener for fabric layer which comprises:

an outer body defining an open face and including a securing surface;

an inner body received within said outer body;

securement means for securing said inner body to said outer body against axial separation and for permitting simultaneous relative rotational and axial movement of said inner body with said outer body;

a securing device supported by said inner body and having a pointed material-engaging end, said inner and outer bodies being rotatably movable between a first, open position and a second, attached position, in the first, open position said inner body being relatively axially displaced from the open face of said outer body and the material-engaging end of said securing device being displaced from the securing surface, in the second, attached position said inner body being relatively axially withdrawn toward the open face of said outer body and the pointed material-engaging end of said securing device being positioned adjacent and facing the securing surface, whereby said inner and outer bodies may be positioned in the first position and material engaged by the end of said securing device, and the outer body may then be rotated relative said inner body to axially withdraw said inner body toward said outer body and to position the securing surface adjacent the end of the securing device to prevent release of the engaged material.

2. A fastener as claimed in claim 1 in which the outer body is of annular configuration and includes an inner wall surface, with one end of said outer body being of toothed configuration to grip material to be fastened and thereby resist rotation of the outer body, said securement means including circumferential and axial-extending cam grooves, closed at each end, being provided on the inner wall surface of the annular outer body.

3. A fastener as claimed in claim 2 in which the inner body is of dished disc form, a finger grip being provided on one surface thereof, said outer body including an open end, the finger grip and projecting through the open end of the outer body.

4. A fastener as claimed in claim 3 in which said inner body includes an outer surface, said fastener comprising angularly-spaced teeth extending from the outer surface of the inner body, said securement means including wires supported by the teeth and projecting radially outwardly thereof to engage in the cam grooves of the outer body.

5. A fastener as claimed in claim 3 in which the securing device is a spiral wire fixed at one end to the outer surface of the inner body, the other and free end of the spiral wire being pointed and the spiral wire being movable outwardly and inwardly of the outer body by the inner body to dispose its pointed end clear of the inner wall surface of the outer body, or adjacent the inner wall surface of the outer body.

6. A fastener as claimed in claim 2 in which the inner body is of two part construction, a first rotatable part being of tubular form with angularly-spaced axial slots formed in its wall and a knurled gripping end disc closing one end thereof, and a second rotatable and axially-movable part being disposed within the first tubular part and being in the form of a disc having radial projections extending through the axial slots and engaging in the cam grooves in the inner wall surface of the outer body.

7. A fastener as claimed in claim 6 in which the securing device is a spiral wire fixed at one end to the disc, the other and free end of the spiral wire being pointed and the spiral wire being movable outwardly and inwardly of the outer body by the disc to dispose its pointed end clear of the inner wall surface of the outer body, or adjacent the inner wall surface of the outer body.

8. A fastener as claimed in claim 1 in which the outer body is cup-shaped defining an inner wall surface, said outer body including, said securement means including circumferential and axial-extending cam grooves, closed at each end, provided on the inner wall surface of said outer body.

9. A fastener as claimed in claim 8 in which the inner body comprises an annular operating ring having angularly-spaced axial slots formed in its wall, a peripherally serrated flange being provided at one end of the ring adapted to abut the open end of the outer body when the operating ring is inserted therein, and a retention lip at the other end of the operating ring engaged in the cam grooves of the outer body to resist axial separation of the operating ring and the outer body.

10. A fastener as claimed in claim 9 comprising a carrier of disc form for the securing device disposed within the operating ring, radial projections on the carrier extending through the axial slots in the operating ring and being engaged in the cam grooves in the inner wall of the outer body.

11. A fastener as claimed in claim 10 in which the securing device is a pair of side-by-side hooks, each secured at one end to the carrier and being pointed at its other end.

12. A fastener as claimed in claim 1 in which the outer body is recessed with a flat surface at the open end of the recess and a recess wall extending about the recess, circumferential and axially-extending cam grooves being formed on the recess wall, and a wall being provided on the flat surface and standing proud of the latter, the wall extending only partially around the flat surface.

13. A fastener as claimed in claim 12 in which the inner body seats in the recess and has radial projections engaging in the cam grooves, the securing device being secured to the inner body and comprising hook means having a pointed end movable, upon rotational and axial movement of the inner body relative to the outer body, between a position where the pointed end lies directly opposite and adjacent the wall and a position clear of the latter.

14. A fastener as claimed in claim 13 in which the securing device is a pair of side-by-side hooks.

15. A fastener as claimed in claim 13 in which the inner body projects above the flat surface of the outer body whereby it can be gripped and rotated.

* * * * *